US006659644B2

(12) United States Patent
Gebhardt

(10) Patent No.: US 6,659,644 B2
(45) Date of Patent: Dec. 9, 2003

(54) PLASTIC BAG WITH ARCUATE VENT PAIRS

(75) Inventor: Terry D. Gebhardt, Longview, TX (US)

(73) Assignee: TC Manufacturing Inc., Co., Evanston, IL (US)

( * ) Notice: Subject to any disclaimer, the term of this patent is extended or adjusted under 35 U.S.C. 154(b) by 0 days.

(21) Appl. No.: 10/051,896

(22) Filed: Jan. 17, 2002

(65) Prior Publication Data

US 2002/0110290 A1 Aug. 15, 2002

Related U.S. Application Data

(60) Provisional application No. 60/262,183, filed on Jan. 17, 2001.

(51) Int. Cl.[7] ..... B65D 33/01
(52) U.S. Cl. ..... 383/103; 383/10; 383/903
(58) Field of Search ..... 383/103, 10, 903; 428/136

(56) References Cited

U.S. PATENT DOCUMENTS

| | | | | | |
|---|---|---|---|---|---|
| 3,495,764 | A | * | 2/1970 | Crane | 383/103 |
| 3,730,076 | A | * | 5/1973 | Levin | 99/347 |
| 4,216,899 | A | * | 8/1980 | Kamp | 383/10 |
| 4,978,231 | A | * | 12/1990 | Ling et al. | 383/11 |
| 5,362,152 | A | * | 11/1994 | Fletcher et al. | 383/8 |
| 6,113,269 | A | * | 9/2000 | DeMatteis et al. | 383/103 |
| 6,126,317 | A | * | 10/2000 | Anderson et al. | 383/207 |
| 6,286,681 | B1 | * | 9/2001 | Wilfong et al. | 206/554 |

FOREIGN PATENT DOCUMENTS

| | | | | |
|---|---|---|---|---|
| CA | 595306 | * | 3/1960 | 383/103 |
| CH | 412693 | * | 11/1966 | 383/10 |
| DE | 2802849 | * | 7/1978 | 383/103 |
| DE | 2807162 | * | 8/1978 | 383/103 |
| FR | 2689099 | * | 10/1993 | 383/10 |
| GB | 2270895 | * | 3/1994 | 383/10 |

* cited by examiner

*Primary Examiner*—Robin A. Hylton
(74) *Attorney, Agent, or Firm*—Welsh & Katz, Ltd.

(57) ABSTRACT

A bag for holding hot food products is provided with pairs of arcuate vents such that hot moist air may escape from the bag to keep food held within fresh. The arcuate vent pairs are placed in certain areas of the body of the bag such that structural strength in the bag is not lost yet hot moist air is allowed to escape. In a preferred embodiment, the bag is made of plastic and has handles defined in the front and rear panels of the bag, such that the gussets, or sides, of the bag are not perforated by handles and the bag presents a neat appearance when it is open and full of product.

14 Claims, 5 Drawing Sheets

PLASTIC BAG WITH ARCUATE VENT PAIRS

This application claims the benefit of Provisional Application 60/262,183 filed Jan. 17, 2001.

FIELD OF THE INVENTION

The present invention concerns a novel plastic storage and transportation bag having vents to allow moist heated air to be removed from the body of the bag such that food transported therein may retain its freshness.

BACKGROUND OF THE INVENTION

Grocery stores and fast food restaurants, as well as other restaurants that offer a take out menu, are packaging foods in plastic bags which are durable, strong, easy to carry, easy to store and are economical to manufacture and use. Such bags are typically airtight and most are designed to keep air out so as to keep foods from becoming stale. However, when transporting hot foods, or fresh baked items, airtight bags tend to not only keep fresh air out, but also keep moist hot air in. Such moist hot air tends to soften baked goods, sandwich breads, fried foods and other items such that dining pleasures are diminished. Fresh cooked items transported in such bags often have the appearance and flavor of left-overs rather than fresh cooked food.

Attempts have been made to circumvent the effect of moist hot air within a plastic bag, but these efforts have generally proven ineffective. In most of these attempts, ventilation holes or slits are made in plastic bags, but as a result of the placement of the ventilation holes or slits and the natural stresses in plastic bags, especially those held from above by handles incorporated in the plastic, the holes or slits fail to open to a desirable degree, and moist hot air remains in the bag to break down the food. Such attempts are found in U.S. Pat. No. 5,362,152 where a T-shirt type plastic bag for carrying hot food is described and U.S. Pat. No. 6,113,269 where an automatic ventilating system for plastic bags is described.

It has been found, however, that the holes or slits defined in bags constructed in accordance with the teachings of these patents often do not open in food transport situation and, as such, are insufficient to keep moist hot air away from hot foods carried therein. In most cases, because of the placement of the holes or slits and/or the design of the slits or holes described therein, the holes and slits fail to open allowing very little or no ventilation.

Further, placement of too many holes or slots, to overcome the lack of ventilation, may weaken the plastic bag such that a structural failure may occur causing the loss of the contents of the bag and a mess.

It would be desirable to have a plastic bag that could be economically and inexpensively produced, stored in quantity in small spaces, and which can store and transport fresh hot foods such that the foods remain fresh and hot. Further, it would be desirable for such a bag be strong and durable and have a desirable appearance both when stored and when in use.

Other objects and advantages of the present invention will become apparent as the description proceeds.

SUMMARY OF THE INVENTION

In accordance with the present invention, a receptacle having at least a front and a back panel and forming a body for carrying objects is provided with a plurality of vents. In a preferred embodiment of the receptacle, the vents are cut into the material of the receptacle and are arcuate in shape. In a preferred embodiment the receptacle is a plastic bag. In one embodiment, the arcuate cuts of the receptacle or bag of the present invention are in the form of half circles, each half circle perforating the body of the bag such that a flap is formed. The vents are placed on the body of the bag in pairs and located such that the endpoints of each half circle vent is located within the half circle of another vent.

In one embodiment of the present invention, pairs of vents are placed on the body of the bag to give maximum opening of the vents when the bag is in use. The vents are so placed so that they do not interfere with the stress caused by the use of a built in handle when the bag is carrying an object. In this manner, the vent cuts, which are in effect holes in the structure of the bag, do not affect the strength of the bag. In a preferred embodiment of the present invention, a bag having front and rear panels as well as side gusset panels is provided. Further, in one embodiment, the bag includes square bottom seals.

It is a feature of the present invention that there is no limit to the style of bag into which the pairs of vents may be defined. The vents of the present invention may be cut or punched into any style bag including but not limited to sinewave (wavy top), deli, side gusseted, bottom gusseted, recloseable, bottom and side sealed, as known by those having skill in the art. Further, the bag of the present invention may be manufactured on conventional bag making equipment with only minimal changes necessary.

The bag of the present invention may be made from plastic tubing or sheeting stock of various gauges and widths depending on the ultimate application for which the bag will be used. It is to be understood that the bag of the present invention may be made of a number of other materials, and variations of the thicknesses of the materials, without departing from the novel scope of the present invention.

The bag of the present invention may be made so that each individual bag is loose, or headered, or saddled, as known by those having skill in the art. The bag may be made in any of the above noted manners depending on the needs of the user. The bag of the present invention can include a handle aperture, which allows for the creation of a handle thereon. The bag can also include square-bottom seals, such as those made, on a four layer side gusseted bag, by heat-sealing the outer two layers of the side gussets together at approximately 45E angle from the bottom apex of the fold while not sealing the two inner layers together.

In a preferred embodiment of the present invention, handles are defined in the front and rear panels of the bag in such a manner that the handles are generally formed after the placement of objects within the bag by the weight of the object applied to openings and perforations defined in the bag panels. In another preferred embodiment of the present invention, a handle design is defined in the front and rear panels of the bag in such a manner that the handles widen out when your hand is inserted. The handle is in the form of a reversed teardrop with the top being of a size having a range from 1 to 1.5 inches, preferably at least 1.25 inches in diameter, and the bottom being of a size having a range of between 0.25 and 0.375 inches, preferably at least 0.375 inches in diameter. The sides of the handle meet at the tangent of both of these diameters. It will be understood by persons having skill in the art that a range of sizes and shapes may be used for the handle of such bags without departing from the novel scope of the present invention.

A more detailed explanation of the invention is provided in the following description and claims and is illustrated in the accompanying drawings.

DETAILED DESCRIPTION OF THE ILLUSTRATIVE EMBODIMENT

Figure 1:
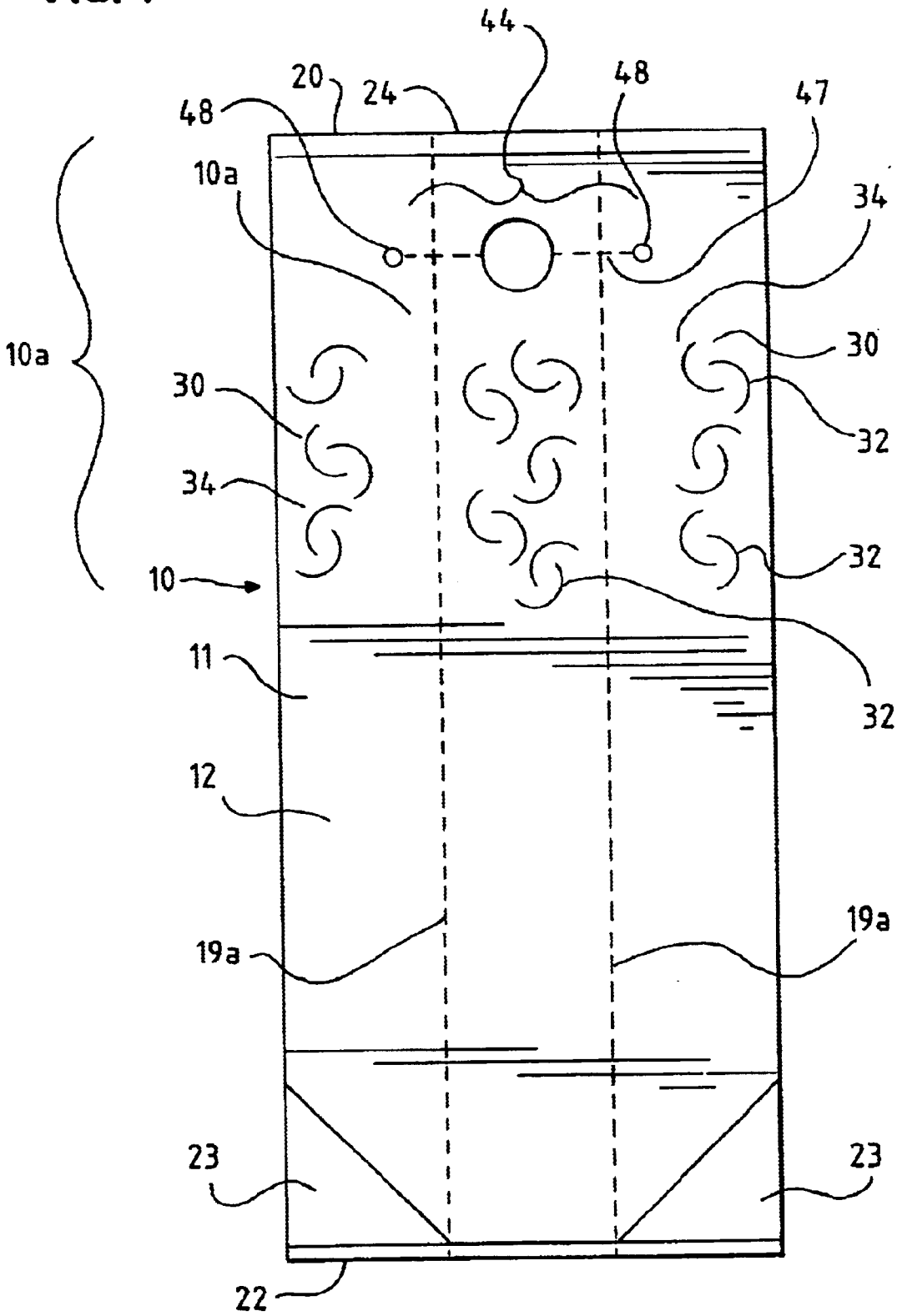
FIG. 1 is an elevational view of an embodiment of a bag of the present invention.
Figure 2:
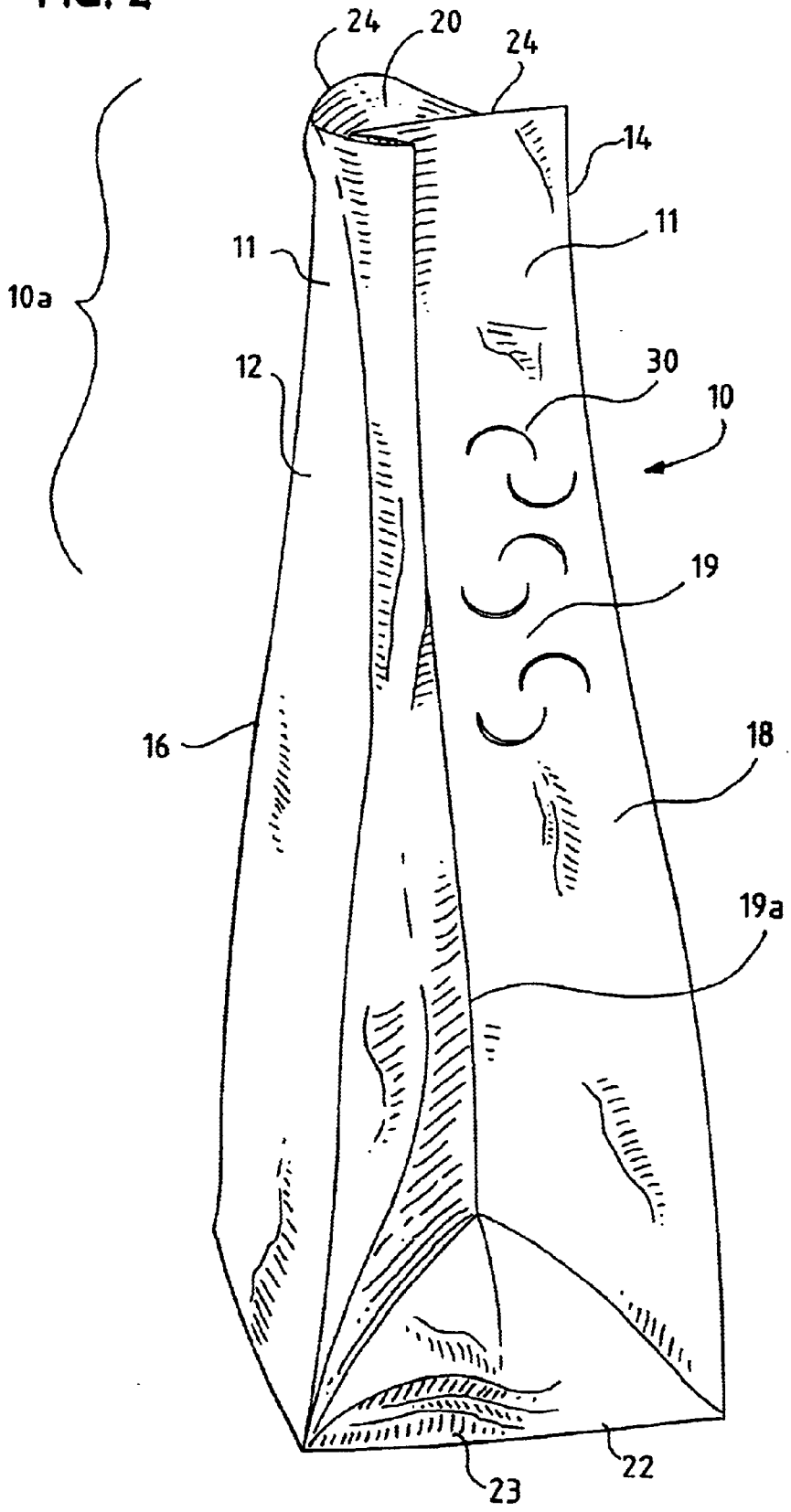
FIG. 2 is a perspective view of an erected bag of the present invention.
Figure 3:
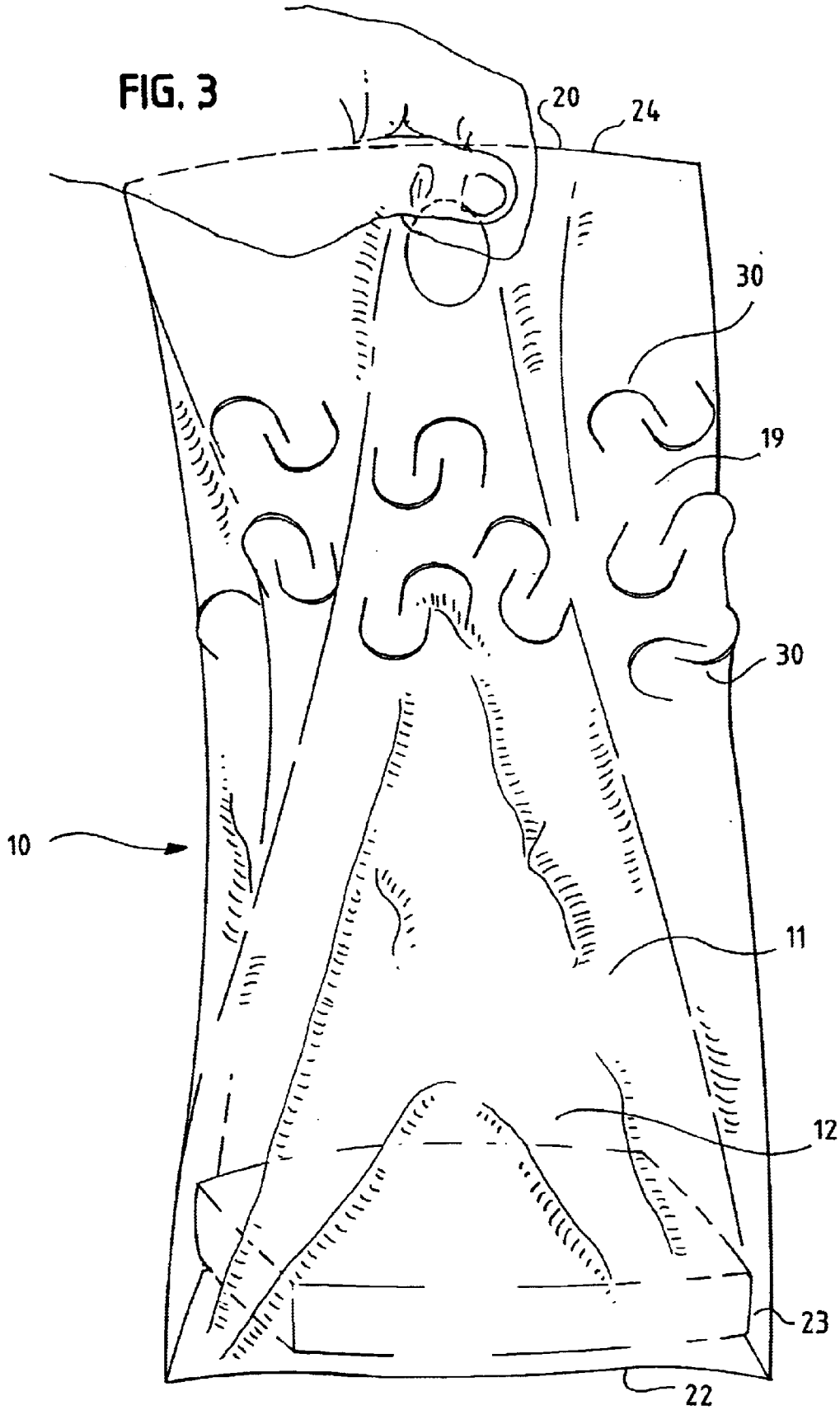
FIG. 3 is perspective view of a bag of the present invention with an object inside.
Figure 4:
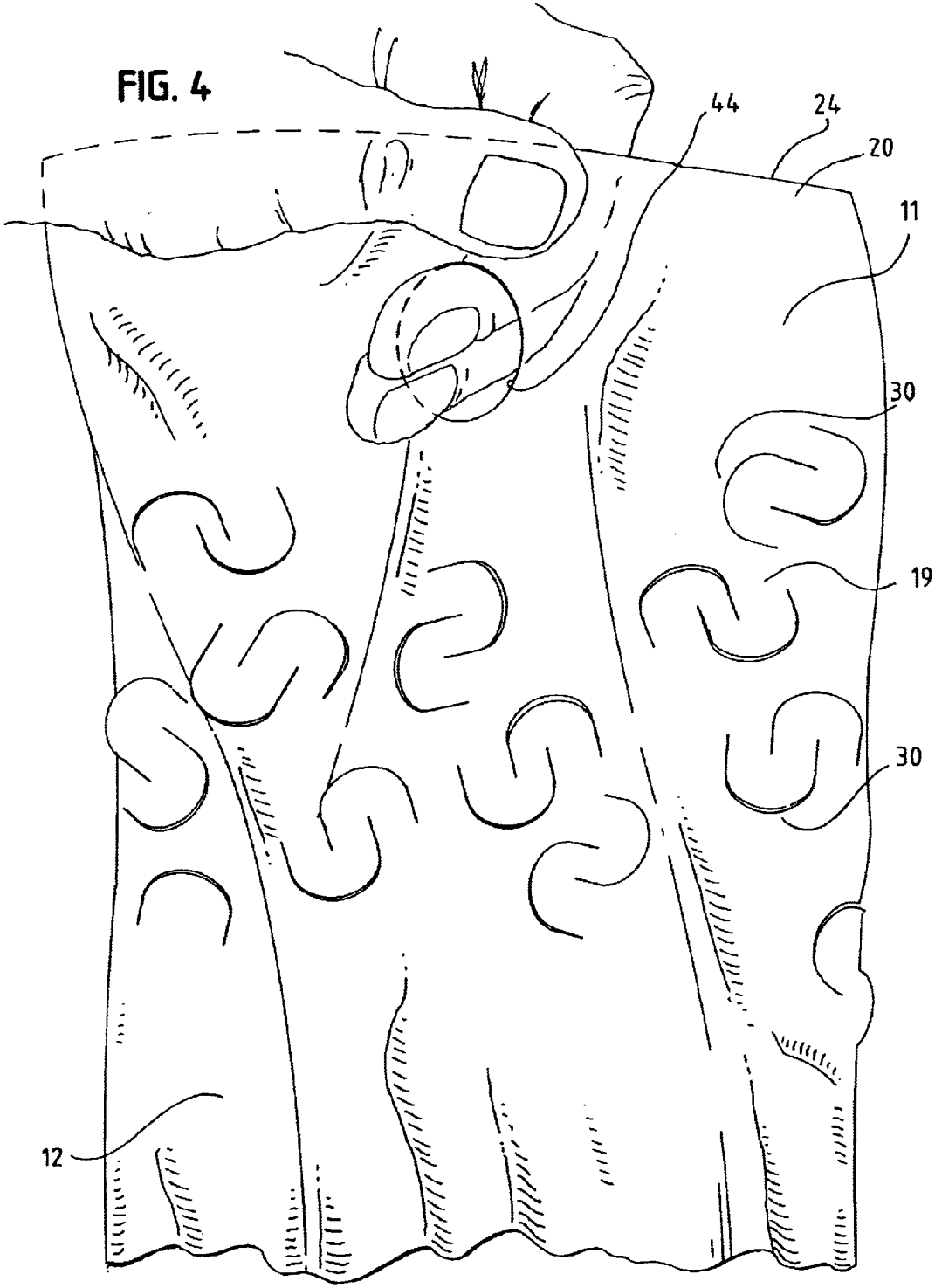
FIG. 4 is a partial perspective view of a filled bag of the present invention
Figure 5:
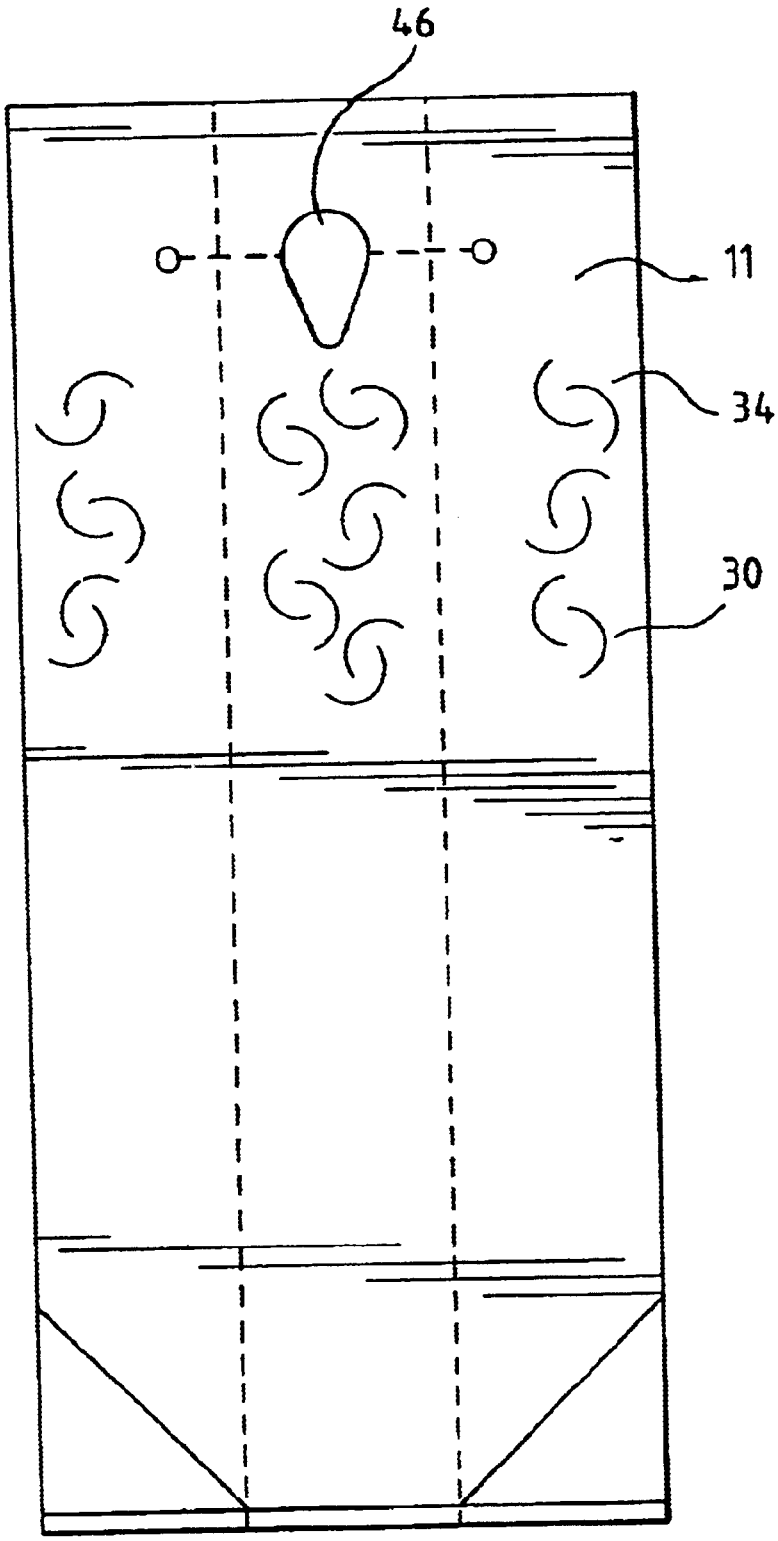
FIG. 5 is an elevational view of another embodiment of the bag of the present invention.

Referring to the drawings, a plastic bag 10 having a plurality of panels 11, namely a front panel 12, a back panel 14, a left side panel 16 and a right side panel 18, is shown. Bag 10 further comprises an opening 20 and a bottom 22. The illustrative bag 10 is a side gusseted plastic bag having square bottom seals 23, however, it is to be understood that the present invention may be utilized on bags having different configurations, including but not limited to a sinewave (wavy top) bag, a deli bag, a bottom gusseted bag, a recloseable bag and a bottom and side seal bag, without departing from the novel scope of the present invention. Bag 10 further comprises a top 24 which is defined by the upper perimeter of the tops of panels 11. Left side panel 16 and right side panel 18 are generally known as gusset areas 19. Gusset areas 19 each further define fold lines 19*a,* running there through.

As can be seen in the Figures, a plurality of arcuate vents 30 are cut into plastic bag 10. Vents 30 are made in the shape of generally half circles 32 are cut such that they are always in vent pairs 34. Each arcuate vent 30 is cut intobag 10 such that at least one end point 30*a* of each half circle 32 falls within the half circle of another vent 30. Vent pairs 34 are placed on bag 10 in a fashion so as to give maximum opening of vents 30 in bag 10 when bag 10 is in use. While vents 30 are described as being cut into bag 10, it is to be understood that vents 30 may be punched in to bag 10, or may be melted into bag 10 or may be molded into bag 10 when bag 10 is created, or may be made in any other fashion and by any other method, known to those having skill in the art, without departing from the novel scope of the present invention.

Vents 30 are placed in such a manner that they are not located in the natural stress areas created by a handle 44, described in greater detail below, and the use of handle 44. In this manner, vents 30 do not cause a weakening or interfere with the structural integrity of bag 10. In a preferred embodiment, vents 30 are placed generally in the upper portion 10*a* of bag 10. Because of the natural phenomenon of heat rising, the placement of vents 30 in the upper portion 10*a* of bag 10 allows the best means for removal of the hot moist air. Any number of vents 30 may be placed in bag 10 without departing from the novel scope of the present invention.

Plastic bag 10 further comprises a unique handle 44 defined in front panel 12 and back panel 14. Handle 44 is comprised of generally round openings 46, generally centered in the front 12 and rear 14 panels, small opening 48 located generally horizontally from approximately the center of openings 46 and on both sides of each opening 46 and perforated line 47 joining each small opening 48 to its respective generally round opening 46. It is to be understood that a handle on a bag of the present invention, while desirable, is optional and that bags without handles are contemplated and are not a departure from the novel scope of the present invention. In the use of handle 44 of bag 10 of the present invention, when an object is placed into bag 10 and the user lifts bag 10, using openings 46, perforated lines 47 are allowed to tear, from opening 46 to small openings 48, allowing the expansion of openings 46, perforated lines 47 and openings 48, into large easy to hold handles (not shown). In this way, wide apertures are made in front panel 12 and rear panel 14, once fully open, leaving gusset areas 19 (in left side 16 and right side 18 panels) intact. Typically, handles in other bags are found in the gusseted areas. In such bags a handle defined in the gusset areas may cut into the fold line of the gusset and detract from the appearance of the bag once the bag is opened.

In a preferred embodiment, handle 44 comprises two openings 46, one on each of front panel 12 and back panel 14. Each opening 46 has a diameter of approximately one inch and is centered in the area between the gusset fold line 19*a*, shown in FIG. 1, and approximately 2 inches from the top of the bag. Two small openings 48, each having a diameter of approximately 0.25 inch, are located approximately 3.5 inches apart with larger opening 46 generally centered between them. Perforated lines 47 are located generally parallel to top line 24 and between each small opening 48 and large opening 46, such that perforated lines 47 connect large opening 46 to each small opening on its respective panel 11. Handle aperture 44 is formed when bag 10 is opened, the user puts a weighty object into bag 10 and lifts bag 10 by openings 46. Such lifting, in the presence of an objects of a sufficient weight within bag 10, allows perforations 47 to tear, between opening 46 and openings 48 respectively in each of front panel 12 and rear panel 14, forming handles 44. In a preferred embodiment, perforated lines 47 are made such that they do not detract from the appearance of bag 10. While handles defined in front panel 12 and rear panel 14 are shown and described, it is to be understood that handles defined in different ways and on different panels of bags, of the present invention, or no handles at all, may be employed without departing from the novel scope of the present invention.

Although an illustrative embodiment of the invention has been shown and described, it is to be understood that various modifications and substitutions may be made by those skilled in the art without departing from the novel spirit and scope of the invention.

What is claimed:

1. A receptacle for carrying objects, comprising:

a front panel and a back panel, at least one of the front panel and back panel defining a plurality of arcuate cuts through the panel such that each such cut forms a flap of panel material, each arcuate cut defining end segments;

the arcuate cut being made such that one end segment of one arcuate cut is generally defined within the flap of another arcuate cut.

2. The receptacle for carrying objects of claim 1, wherein the front and back panels are constructed of plastic.

3. The receptacle for carrying objects of claim 1, wherein the arcuate cuts are made in pairs.

4. The receptacle for carrying objects of claim 1, wherein the end segment of one arcuate cut is generally centered within the flap of another arcuate cut.

5. The receptacle for carrying objects of claim 1, including a first side panel and a second side panel, wherein at least one of the first side panel and the second side panel defines a plurality of arcuate cuts.

6. The receptacle for carrying objects of claim 1, wherein both the front panel and the back panel define the plurality of arcuate cuts.

7. The receptacle for carrying objects of claim 1, including a handle, the front and rear panels comprised of materials susceptible of withstanding the stress associated with carrying objects and wherein the arcuate cuts are made so as not to decrease the ability of the panels from withstanding stress when the handles are used to carry objects.

8. The receptacle for carrying objects of claim 1, wherein the receptacle is a plastic bag, having the arcuate cuts placed, in pairs about the front panel and the back panel.

9. A receptacle for carrying objects, comprising:

a front panel, a back panel, a first side panel and a second side panel, wherein at least one of the first side panel, the second side panel, the front panel, or the back panel defines a plurality of arcuate cuts, the panels being made of plastic, at least one of the front panel, back panel, or side panels, defining a plurality of arcuate cuts, having end segments, through the panel such that each such cut forms a flap of panel material;

the arcuate cuts being made such that one end segment of one arcuate cut is generally centered in the flap of another arcuate cut.

10. The receptacle for carrying objects of claim 9, wherein both the front panel and the back panel define the plurality of arcuate cuts.

11. The receptacle for carrying objects of claim 9, wherein the arcuate cuts are made in pairs.

12. The receptacle for carrying objects of claim 9, wherein the arcuate cuts are placed about either the front panel or the rear panel and the side panels.

13. The receptacle for carrying objects of claim 9, including handle holes defined in the front panel and the rear panel, the front and rear panels comprised of materials susceptible of withstanding the stress associated with carrying objects and wherein the arcuate cuts are made so as not to decrease the ability of the panels from withstanding stress when the handles are used to carry objects.

14. The receptacle for carrying objects of claim 9, wherein the receptacle is a plastic bag, having arcuate cuts placed, in pairs, within a section of the bag about the front panel and the back panel.

* * * * *